US006506096B1

(12) United States Patent
Ishimoto

(10) Patent No.: US 6,506,096 B1
(45) Date of Patent: Jan. 14, 2003

(54) RUNNING TOY

(75) Inventor: Zenichi Ishimoto, Tokyo (JP)

(73) Assignee: Nikko Co., Ltd., Tokyo (JP)

( * ) Notice: Subject to any disclaimer, the term of this patent is extended or adjusted under 35 U.S.C. 154(b) by 0 days.

(21) Appl. No.: 09/958,358

(22) PCT Filed: Feb. 8, 2000

(86) PCT No.: PCT/JP00/00683

§ 371 (c)(1),
(2), (4) Date: Oct. 9, 2001

(87) PCT Pub. No.: WO01/58555

PCT Pub. Date: Aug. 16, 2001

(51) Int. Cl.[7] ..... A63H 17/267
(52) U.S. Cl. ..... 446/437; 446/448
(58) Field of Search ..... 446/431, 448, 446/454, 457, 460, 465, 466, 437

(56) References Cited

U.S. PATENT DOCUMENTS 4,518,176 A * 5/1985 Hegedus ..... 280/220
4,666,418 A * 5/1987 Wolf ..... 446/273
5,553,878 A * 9/1996 Davignon et al. ..... 280/229
5,553,879 A * 9/1996 Niemeyer et al. ..... 280/229
5,762,533 A * 6/1998 Tilbor et al. ..... 280/43.23
6,129,607 A * 10/2000 Hoeting et al. ..... 446/396

FOREIGN PATENT DOCUMENTS

| | | |
|---|---|---|
| JP | 53-136296 | 10/1978 |
| JP | 56-49178 | 5/1981 |
| JP | 60-88991 | 6/1985 |
| JP | 2-26557 | 7/1990 |
| JP | 3-129193 | 12/1991 |
| JP | 4-114686 | 4/1992 |

* cited by examiner

*Primary Examiner*—Jacob K. Ackun
(74) *Attorney, Agent, or Firm*—Young & Thompson

(57) ABSTRACT

A running toy, wherein four running wheels (14) mounted detachably on the axles of a running toy main body (10) are provided with two axle inserting holes having those profiles formed so that they match the cross-sections of angular shaft of these axles, respectively, one of these axle inserting holes is formed at the center of running wheel (14), and the other axle inserting hole is formed at a position eccentric from the center of the running wheel (14) so as to obtain an irregular running mode.

2 Claims, 8 Drawing Sheets

RUNNING TOY

FIELD OF THE INVENTION:

This invention relates to a remote control running toy, and more particularly to a running toy moving on four wheels.

BACKGROUND ART

A remote control running toy generally includes a running body capable of moving in the longitudinal direction thereof, and a remote controller adapted to control the running toy body remotely. Such a running body of the running toy is formed of a running toy body having plural axles, and plural running wheels mounted on the axles of the running toy body.

Almost all such running toys in which the running toy body is provided with four wheels have heretofore been moved in a regular running mode. Therefore, it was impossible in a related art running toy to provide various running modes suiting a user's taste. Although there is a running toy having, for example, a jumping function besides a function of moving itself in a regular running mode, such a running toy has a complicated construction or is liable to get out of order.

The present invention has been made in view of the above-mentioned circumstances, and provides a running toy capable of easily obtaining various running modes in accordance with a user's taste.

DISCLOSURE OF THE INVENTION

The present invention is provided with a running toy body having an axle of a right front wheel, an axle of a left front wheel, an axle of a right rear wheel and an axle of a left rear wheel; four running wheels mounted detachably on the axles of the running toy body; and a driving unit adapted to rotate the running wheels via the axles, each of the running wheels having two axle inserting holes, one of which is formed in the center of the running wheel, and the other of which is formed in the position on the running wheel which deviates from the center thereof.

In the running toy according to the present invention, the driving unit may be formed of a first driving motor adapted to drive the axle of the right front wheel and that of the right rear wheel, a second driving motor adapted to drive the axle of the left front wheel and that of the left rear wheel, a first gear mechanism adapted to transmit the torque of the first driving motor to the axle of the right front wheel and that of the right rear wheel, and a second gear mechanism adapted to transmit the torque of the second driving motor to the axle of the left front wheel and that of the left rear wheel. Each of the axles preferably includes a cross-sectionally angular shaft supported rotatably on the running toy body, a screw rod projecting from an end of the angular shaft, and a nut for tightening the screw rod. Each of the axle inserting holes preferably has a contour the shape of which is in conformity with that of a cross section of the angular shaft. Each of the running wheels preferably has two through holes for passing the relative screw rod therethrough.

BEST MODE FOR CARRYING OUT THE INVENTION

Figure 1:
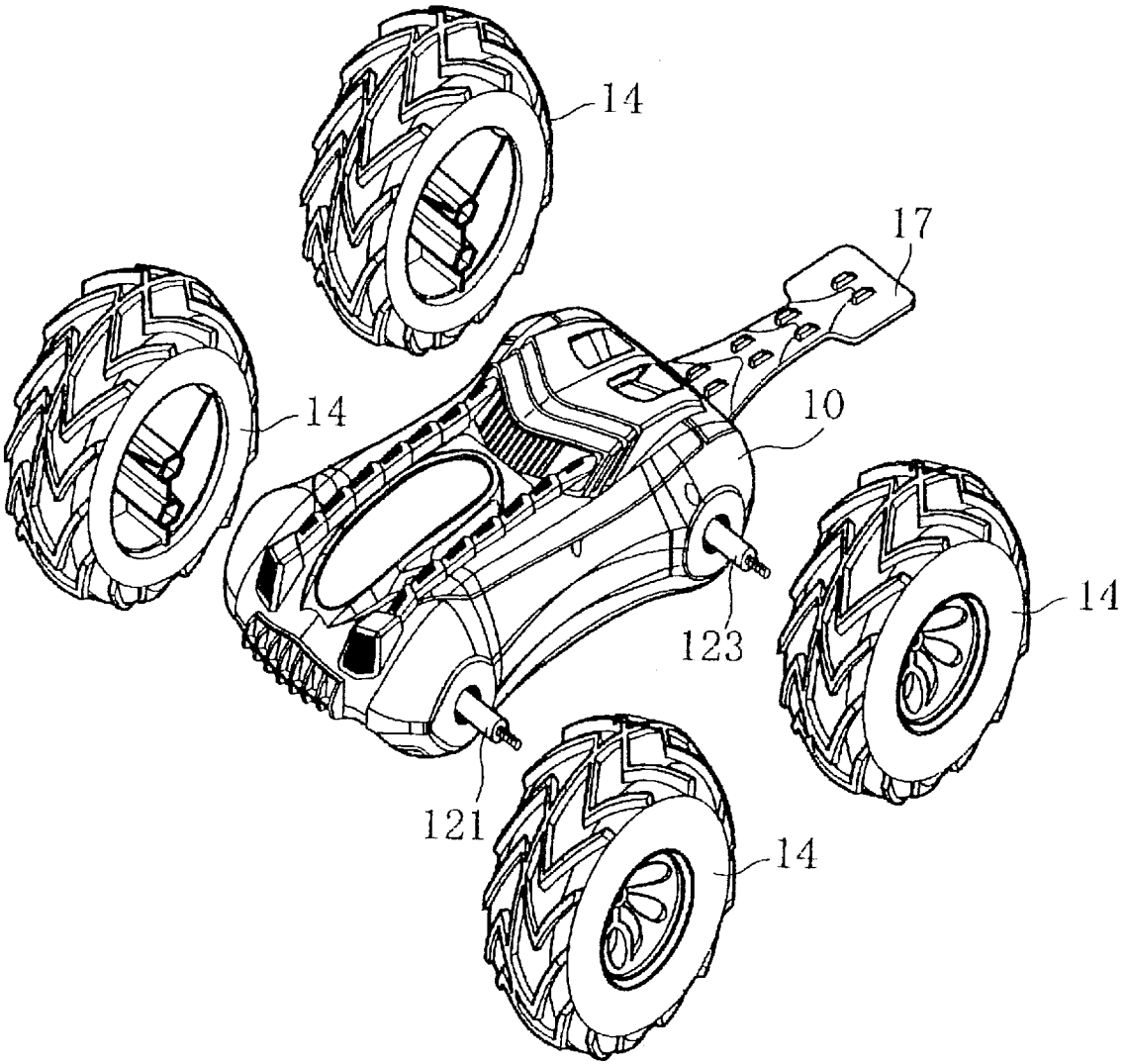
FIG. 1 is a perspective view of a mode of embodiment of the running toy according to the present invention.
Figure 2:
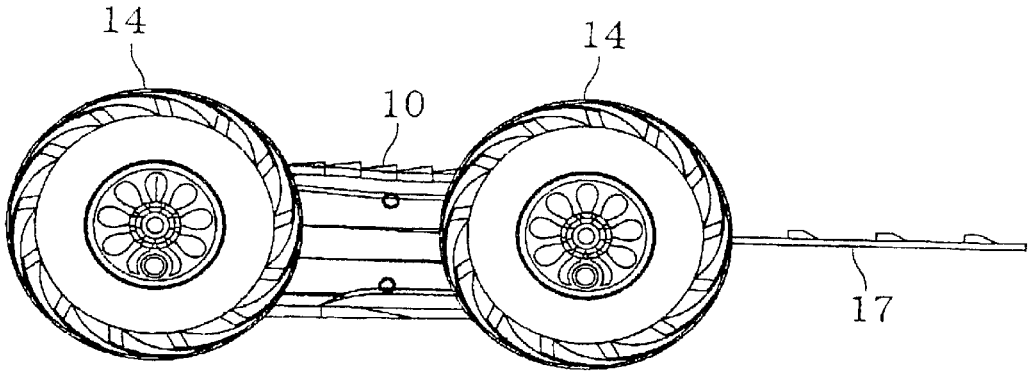
FIG. 2 is a side view of the running toy shown in FIG. 1.
Figure 3:
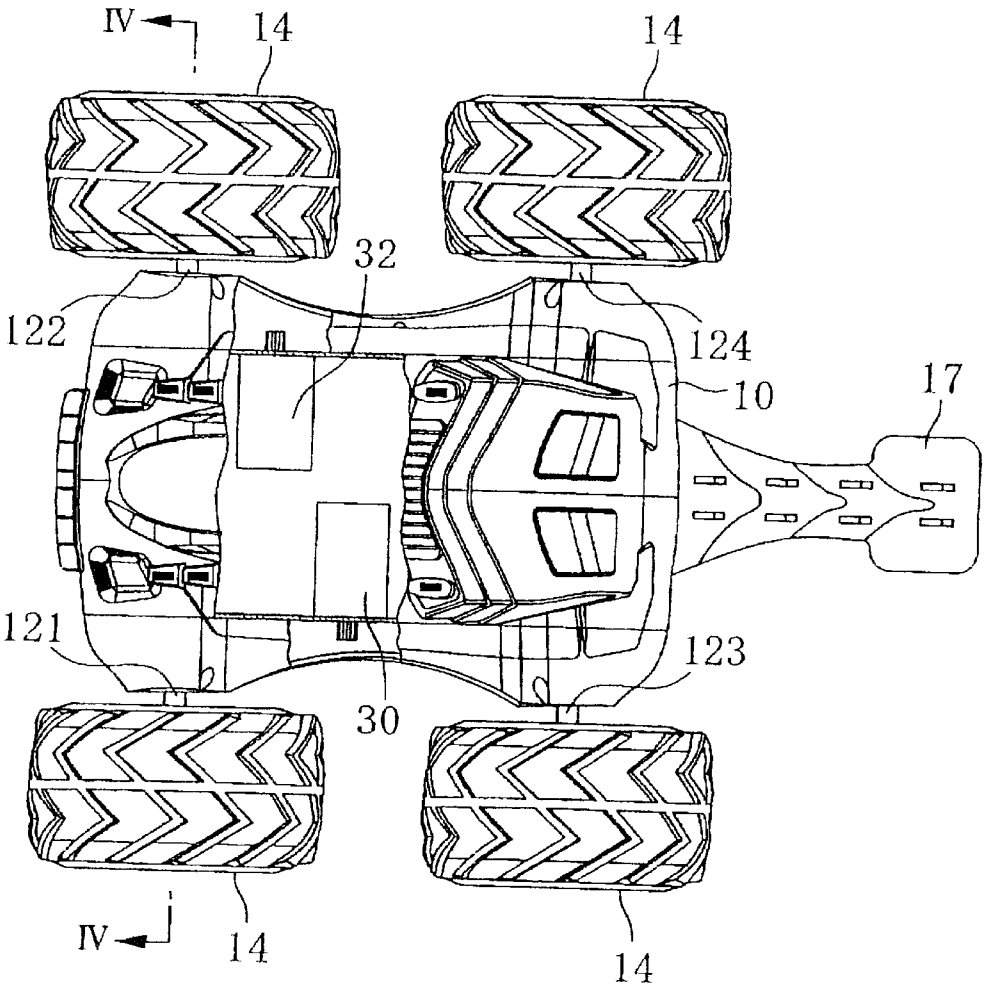
FIG. 3 is a plan view of the running toy shown in FIG. 2.
Figure 4:
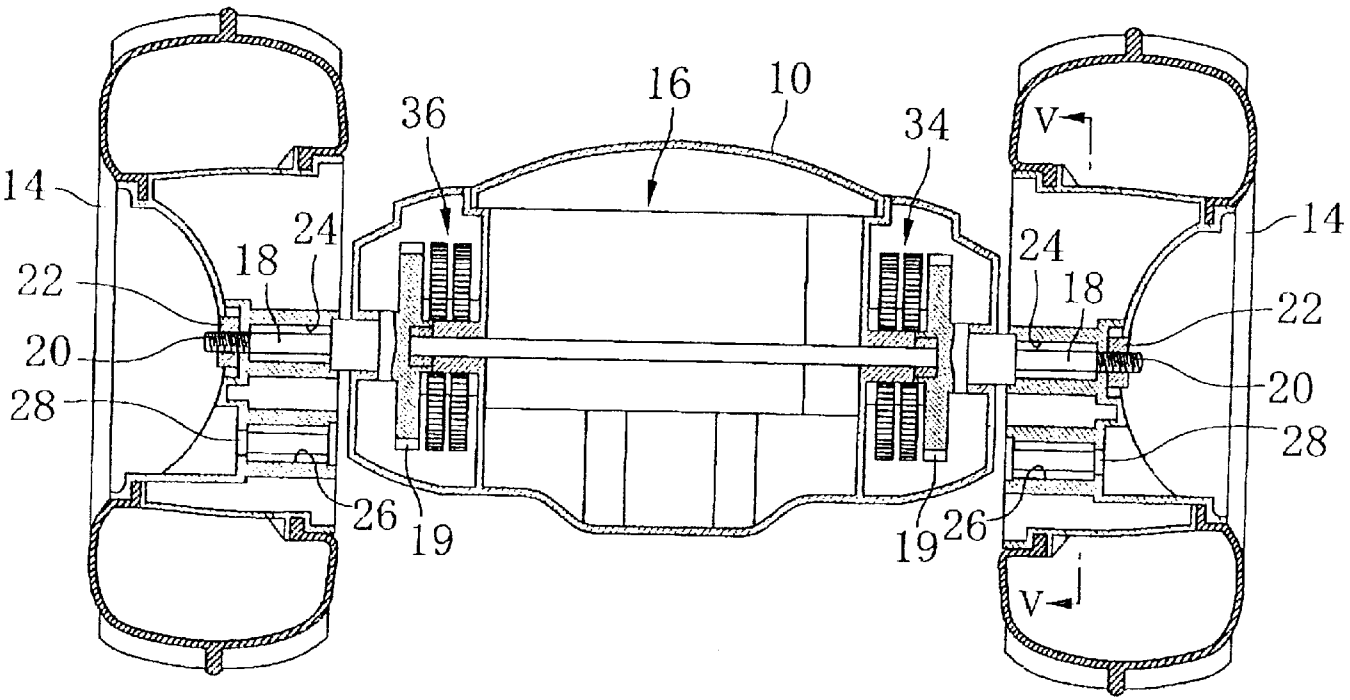
FIG.4 is a sectional view taken along the line IV—IV in FIG. 3.

Referring to FIG. 1 to FIG. 3, a mode of embodiment of the running toy according to the present invention is provided with a running toy body 10 having an axle 121 of a right front wheel, an axle 122 of a left front wheel, an axle 123 of a right rear wheel and an axle 124 of a left rear wheel, four running wheels 14 mounted detachably on the axles 121–124 of the running toy body 10, a driving unit 16 (refer to FIG. 4) adapted to drive these wheels 14 via the axles 121–124, and a member 17 for preventing the running toy body 10 from overturning.

Each of the axles 121–124 is formed of an angular shaft 18 (refer to FIG. 4) supported rotatably on the running toy body 10, a screw rod 20 extended from one end of the angular shaft 18, and a nut 22 for tightening the screw rod 20. A pinion gear 19 for rotating each of the axles 121–124 is formed on each angular shaft 18 so as to be integral therewith. The angular shafts 18 are formed of a plastic, while the screw rods 20 and tightening nuts 22 are formed of a metal.

Figure 5:
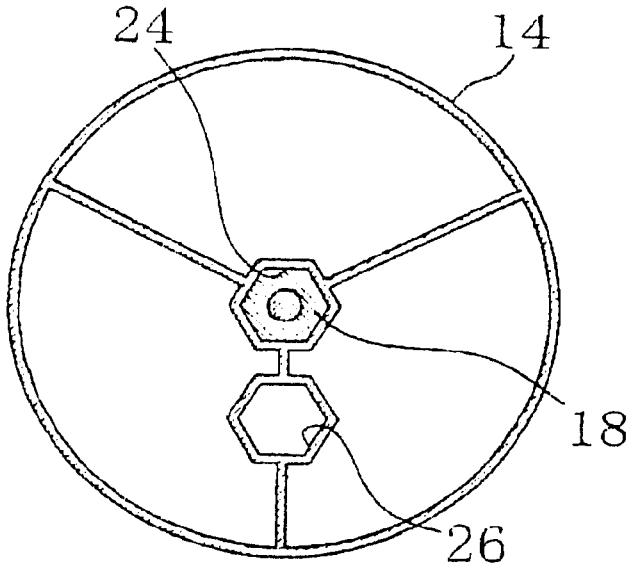
FIG. 5 is a sectional view taken along the line V—V in FIG. 4.

Each wheel 14 is provided with two axle inserting holes 24, 26 (refer to FIG. 4 and FIG. 5) the shape of the contours of which is in conformity with that (for example, regular hexagon) of a cross section of each angular shaft 18. One 24 of these two axle inserting holes 24, 26 is formed in the center of the wheel 14, and the other 26 in the portion of the wheel 14 which deviates from the center thereof. Each wheel 14 is also provided with two through holes 28, 28 through which the screw rod 20 is passed, and these through holes 28, 28 are formed in closed end walls of the axle inserting holes 24, 26.

The turnover preventing member 17 is formed out of a plastic, and fixed detachably to a rear end of the running toy body 10.

The driving unit 16 is formed of a first driving motor 30 (refer to FIG. 3) adapted to drive the axle 121 of right front wheel and the axle 123 of a right rear wheel, a second driving motor 32 adapted to drive the axle 122 of a left front wheel and the axle 124 of a left rear wheel, a first gear mechanism 34 (refer to FIG. 4) adapted to transmit the torque of the first driving motor 30 to the axle 121 of the right front wheel and the axle 123 of the right rear wheel, and a second gear mechanism 36 adapted to transmit the torque of the second driving motor 32 to the axle 122 of the left front wheel and the axle 124 of the left rear wheel.

The driving motors 30, 32 are controlled by a control unit mounted on the running toy body 1.0, and the control unit controls the driving motors 30, 32 on the basis of an operating signal transmitted from a remote controller.

Figure 6:
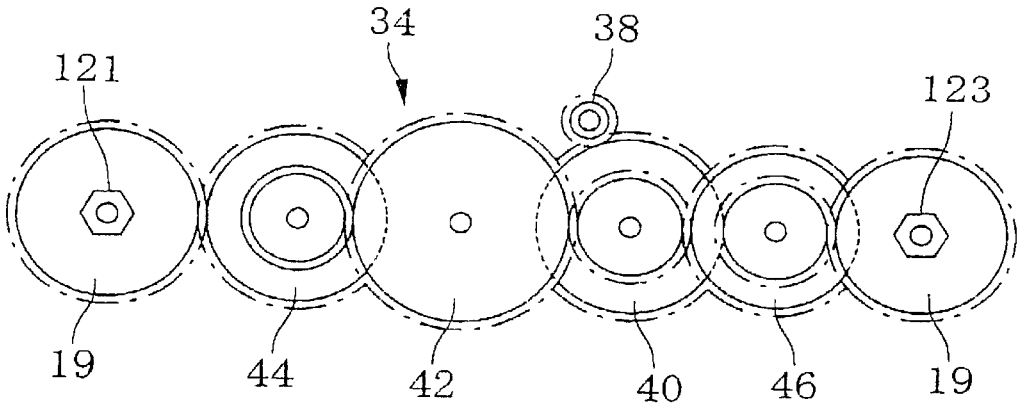
FIG. 6 is a side view of a first gear mechanism shown in FIG. 4.

The first gear mechanism 34 is formed of a motor gear 38 (refer to FIG. 6) mounted on a rotary shaft of the driving motor 30, and plural gears 40, 42, 44, 46 adapted to transmit the rotation of this motor gear 38 to the pinion gears 19, 19 mounted on the axle 121 of the right front wheel (121) and axle 123 of the right rear wheel (123).

Figure 7:
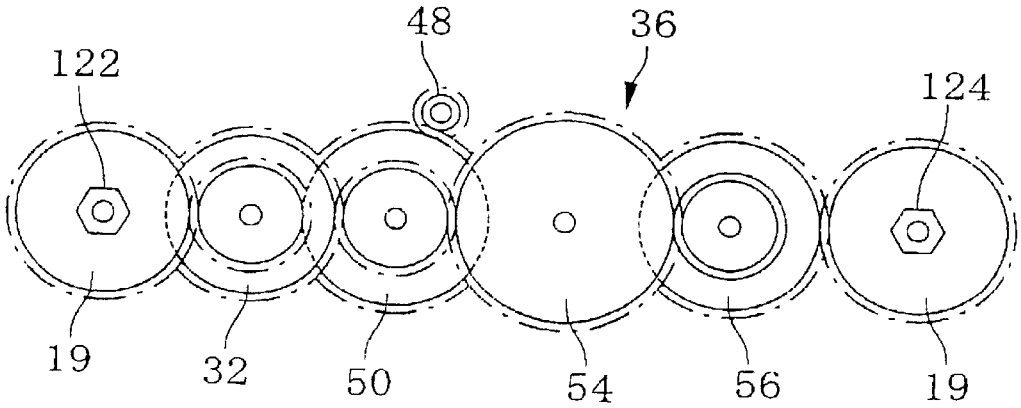
FIG. 7 is a side view of a second gear mechanism shown in FIG. 4.

The second gear mechanism 38 is formed of a motor gear 48 (refer to FIG. 7) mounted on a rotary shaft of the driving motor 34, and plural gears 50, 52, 54, 56 adapted to transmit the rotation of this motor gear 48 to the pinion gears 19, 19 mounted on the axle 122 of the left front wheel and axle 124 of the left rear wheel.

In this arrangement, when the axles 121–124 of the running toy body 10 are fixed in the axle inserting holes 24 of the four wheels 14, the centers of the rotation of the axles 121–124 and those of the wheels 14 agree with each other, so that the running toy body 10 can be moved in a regular running mode.

Figure 8:
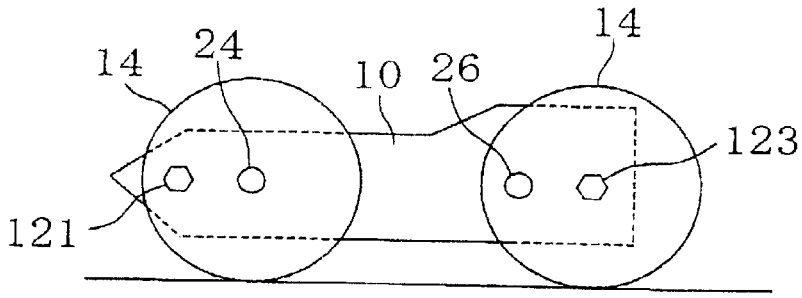
FIG. 8 is a drawing showing a case where front running wheels are mounted on relative axles at the portions of the wheels which deviate from the centers thereof.

As shown in FIG. 8, when the axle 121 of the right front wheel and the axle 122 of the left front wheel on the running toy body 10 are fixed in the axle inserting holes 24 of the relative wheels 14 with the axle 123 of the right rear wheel and the axle 124 of the left rear wheel on the running toy body 10 fixed in the axle inserting holes 26 of the relative wheels 14, the running toy body 10 can be moved in a running mode in which a front portion only of the running toy body 10 jumps up and down.

Figure 9:
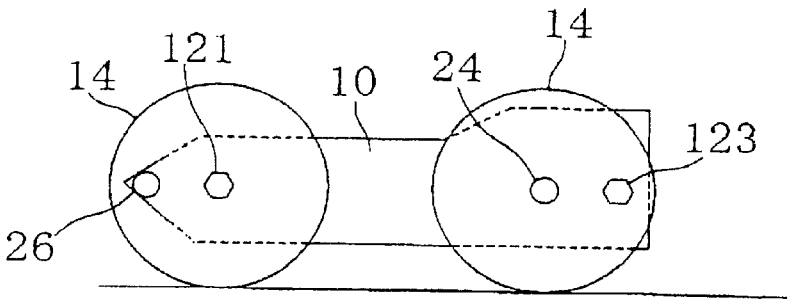
FIG. 9 is a drawing showing a case where rear running wheels are mounted on relative axles at the portions of the wheels which deviate from the centers thereof.

As shown in FIG. 9, when the axle 121 of the right front wheel and the axle 122 of the left front wheel on the running toy body 10 are fixed in the axle inserting holes 26 of the relative wheels 14 with the axle 123 of the right rear wheel and the axle 124 of the left rear wheel on the running toy body 10 fixed in the axle inserting holes 24 of the relative wheels 14, the running toy body 10 can be moved in a running mode in which a rear portion only of the running toy body 10 jumps up and down.

Figure 10:
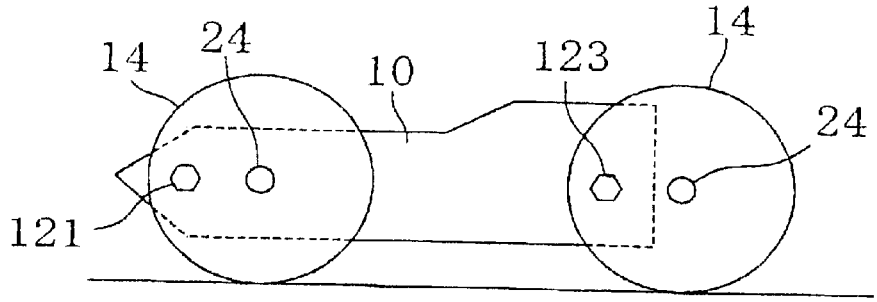
FIGS. 10 and 11 show cases where four running wheels are mounted on respective axles at the portions of the wheels which deviate from the centers thereof.

As shown in FIG. 10, when the axle 121 of the right front wheel, the axle 122 of the left front wheel, the axle 123 of the right rear wheel and the axle 124 of the left rear wheel on the running toy body 10 are fixed in the axle inserting holes 26 of the relative wheels 14, the running toy body 10 can be moved in a running mode in which the running toy body 10 as a whole jumps up and down.

Figure 11:
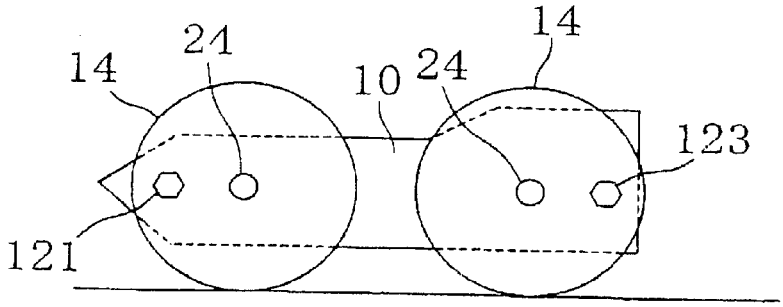

As shown in FIG. 11, when the axles 121–124 of the running toy body 10 are fixed in the axle inserting holes 26 of the wheels 14 so that the positions of the axle inserting holes 26 on the side of the front wheels and those of the axle inserting holes 26 on the side of the rear wheels are thereby shifted, the running toy body 10 can be moved in a running mode in which the running toy body 10 advances like a measuring worm.

INDUSTRIAL APPLICABILITY

As described above, the running toy according to the present invention is capable of taking various running modes easily in accordance with a user's taste, and making a user enjoy running modes of the running toy which are different from a regular running mode thereof

What is claimed is:

1. A toy vehicle comprising:

a body and four wheels, each of said wheels having a centered axle-inserting hole and an off-center axle-inserting hole, each of said centered and off-center holes being a polygon with sides of equal length;

four axles that are rotatably mounted on said body and that carry said wheels, each of said four axles comprising a polygon-shaped shaft corresponding to said polygon of said centered and off-center holes, a threaded rod projecting from one end of said shaft, a nut threaded onto said threaded rod, and a pinion gear extending radially outwardly from an opposite end of said shaft, each of said four axles being removably inserted into a respective one of said centered and off-center holes and held therein by said nut; and two motors that each drive a respective gear train, each said gear train engaging two said pinion gear on a respective side of the toy vehicle.

2. The toy vehicle of claim 1, where each said gear train comprises plural gears whose axes of rotation are parallel and that, when meshed together, extend on a respective side of the vehicle to a front one of said wheels to a rear one of said wheels.

* * * * *